US011051568B2

(12) United States Patent
Reimer

(10) Patent No.: US 11,051,568 B2
(45) Date of Patent: Jul. 6, 2021

(54) BARRIER PANEL FOR SELECTIVE COUPLING BETWEEN JACKET AND TROUSERS

(71) Applicant: Milton D. Reimer, Oak Bluff (CA)

(72) Inventor: Milton D. Reimer, Oak Bluff (CA)

( * ) Notice: Subject to any disclaimer, the term of this patent is extended or adjusted under 35 U.S.C. 154(b) by 206 days.

(21) Appl. No.: 16/270,709

(22) Filed: Feb. 8, 2019

(65) Prior Publication Data

US 2019/0246723 A1 Aug. 15, 2019

Related U.S. Application Data

(60) Provisional application No. 62/628,667, filed on Feb. 9, 2018.

(51) Int. Cl.

| | |
|---|---|
| ***A41D 13/02*** | (2006.01) |
| ***A41D 1/02*** | (2006.01) |
| ***A41D 1/06*** | (2006.01) |
| ***A41D 31/102*** | (2019.01) |
| ***A41D 1/082*** | (2018.01) |
| ***A41D 3/00*** | (2006.01) |
| ***A41D 15/00*** | (2006.01) |
| ***A41D 27/20*** | (2006.01) |

(52) U.S. Cl.

CPC ..... *A41D 31/102* (2019.02); *A41D 1/02* (2013.01); *A41D 1/06* (2013.01); *A41D 1/082* (2013.01); *A41D 3/00* (2013.01); *A41D 13/02* (2013.01); *A41D 15/00* (2013.01); *A41D 15/002* (2013.01); *A41D 27/20* (2013.01); *A41D 2300/22* (2013.01); *A41D 2300/322* (2013.01); *A41D 2300/324* (2013.01); *A41D 2600/10* (2013.01)

(58) Field of Classification Search

CPC ..... A41D 31/102; A41D 1/02; A41D 1/06
USPC ..... 2/46, 69, 70, 85, 87, 93
See application file for complete search history.

(56) References Cited

U.S. PATENT DOCUMENTS

| | | | | |
|---|---|---|---|---|
| 1,773,456 A * | 8/1930 | Good | ..... | A41F 5/00 2/85 |
| 2,562,234 A * | 7/1951 | Gottschalk | ..... | A41B 1/06 2/117 |
| 3,737,916 A * | 6/1973 | Grenier | ..... | A41D 3/00 2/70 |
| 7,404,214 B2 * | 7/2008 | Woolcott | ..... | A41D 3/00 2/85 |

(Continued)

FOREIGN PATENT DOCUMENTS

| | | |
|---|---|---|
| GB | 469135 | 7/1937 |

*Primary Examiner* — Katherine M Moran
(74) *Attorney, Agent, or Firm* — Ryan W. Dupuis; Kyle R. Satterthwaite; Ade & Company Inc.

(57) ABSTRACT

A barrier panel is coupled between a jacket and a pair of trousers which provides a moisture resistant barrier therebetween about a full circumference of the torso of the user. The barrier panel cam be joined to both the jacket and trousers by zippers extending about a full circumference thereof, together with an end zipper joining the ends of the panel along the full width thereof to provide a complete barrier between the trousers and jacket. Alternatively, the barrier panel can be stitched to the trousers and received within a pocket formed by a cover panel on the trousers when not in use. The barrier panel has an elastic member spanning the full width and height of the panel and a moisture resistant membrane fully spanning one side of the elastic member.

16 Claims, 4 Drawing Sheets

(56) References Cited

U.S. PATENT DOCUMENTS

| | | | | |
|---|---|---|---|---|
| 8,522,368 | B2 * | 9/2013 | McIntosh | A41D 3/02 2/458 |
| 2012/0096627 | A1 | 4/2012 | Gosse | |

* cited by examiner

BARRIER PANEL FOR SELECTIVE COUPLING BETWEEN JACKET AND TROUSERS

This application claims the benefit under 35 U.S.C. 119(e) of U.S. provisional application Ser. No. 62/628,667, filed Feb. 9, 2018.

FIELD OF THE INVENTION

The present invention relates to a barrier panel which can be coupled between a bottom end of the jacket and a top end of a pair of trousers while enabling the jacket and trousers to be selectively separated from one another, and more particularly the present invention relates to a barrier panel which provides a moisture resistant barrier between the jacket and the trousers substantially about a full circumference of the torso of the user.

BACKGROUND

Winter garments for protecting users from wet and cold weather include various forms of jackets and trousers which can protect the upper and lower body portions of the user respectively. The gap between the jacket and the trouser is susceptible to allow cold or wet elements to enter into the garments to the discomfort of the user.

To provide greater protection to the user, single piece garments are also available which cover both of the upper and lower body portions of the user; however, such garments are limited in their use as the upper and lower covering portions of the single piece garment cannot be separate from one another for individual use. U.S. Pat. No. 7,874,109 to Volcom, Inc. addresses some of the disadvantages of the prior art by providing a jacket and trousers garment set which can be selectively joined to one another. Although this allows use of the upper and lower covering portions of the garment independently if desired, the coupling is accomplished by a powder skirt which is formed by separate panels connected end to end with one another so as to include an elasticized panel susceptible to water penetration and a water resistant panel which occupies the majority of the area of the powder skirt so as to limit relative movement between the jacket and pants. Furthermore, the powder skirt is connected using snaps at opposing ends of the skirt and zippers that extend only partway about a circumference of the user so that numerous gaps remain between the jacket and trousers through which cold air and moisture can enter.

SUMMARY OF THE INVENTION

According to one aspect of the invention there is provided a garment set comprising:

a water resistant jacket including (i) a torso portion for covering a torso of a user in which the torso portion has a bottom edge and a closure mechanism operatively connected between two opposing front edges spanning a full height of the torso portion for movement between open and closed positions of the jacket, and (ii) a first upper zipper portion on an inner surface of the torso portion at a location spaced above the bottom edge and spanning in a circumferential direction about the torso portion between the opposing front edges;

water resistant trousers including (i) a main body for covering the legs of the user, and (ii) a waist opening in the main body receiving a waist of the user therethrough; and a barrier panel which is elongate in a longitudinal direction and which is adapted to be selectively coupled between the water resistant jacket and the water resistant trousers, the barrier panel including (i) a pair of opposing upper and lower edges extending in the longitudinal direction of the barrier panel between two end edges at longitudinally opposed ends of the barrier panel, the lower edge being joined to the trousers, (ii) a second upper zipper portion extending along the upper edge between the opposing end edges, the second upper zipper portion being adapted to be selectively joined with the first upper zipper portion along the length thereof, (iii) a pair of end zipper portions extending along the end edges respectively, the end zipper portions being adapted to selectively join with one another;

the barrier panel comprising an elastic member spanning in a lateral direction across a full width between the upper and lower edges and spanning in the longitudinal direction across a full length between the opposing end edges such that the barrier panel is fully resilient in both the lateral direction and the longitudinal direction across the full width and the full length thereof.

By forming the barrier panel of elastic material that spans the full length and width between opposing edges that are joined to the jacket and trousers respectively, the barrier panel provides a greater freedom of movement to the user at the coupling location between the jacket and trousers.

The barrier panel preferably further comprises a moisture resistant membrane spanning one side of the elastic member across the full width and across the full length thereof, in which the moisture resistant membrane is resiliently deformable together with the elastic member. The membrane provides full coverage to the barrier panel to resist penetration of moisture into the garment.

In some embodiments, for example when the barrier panel is stitched to the trousers, a cover panel may be joined externally to the trousers along one edge of the cover panel to define a pocket extending circumferentially about the waist opening in the trousers. Preferably the lower edge of the barrier panel being joined externally on the trousers within the pocket defined by the cover panel such that the barrier panel can be concealed within the pocket defined by the cover panel.

According to a second aspect of the present invention there is provided a garment set comprising:

a water resistant jacket including (i) a torso portion for covering a torso of a user in which the torso portion has a bottom edge and a closure mechanism operatively connected between two opposing front edges spanning a full height of the torso portion for movement between open and closed positions of the jacket, and (ii) a first upper zipper portion on an inner surface of the torso portion at a location spaced above the bottom edge and spanning in a circumferential direction about the torso portion between the opposing front edges;

water resistant trousers including (i) a main body for covering the legs of the user, (ii) a waist opening in the main body receiving a waist of the user therethrough, and (iii) a first lower zipper portion on the main body to extend in a circumferential direction about the waist opening; and a barrier panel which is elongate in a longitudinal direction and which is adapted to be selectively coupled between the water resistant jacket and the water resistant trousers, the barrier panel including (i) a pair of opposing upper and lower edges extending in the longitudinal direction of the barrier panel between two end edges at longitudinally opposed ends of the barrier panel, (ii) a second upper zipper portion extending along the upper edge between the opposing end edges, the second upper zipper portion being adapted to be selectively joined with the first upper zipper portion along the length thereof, (iii) a second lower zipper portion extending along the lower edge between the opposing end edges, the second lower zipper portion being adapted to be selectively joined with the first lower zipper portion along the length thereof, and (iv) a pair of end zipper portions extending along the end edges respectively, the end zipper portions being adapted to selectively join with one another.

The combination of upper and lower zipper portions spanning about of full circumference of the garment set with end zipper portions spanning the full ends of the panel provide a complete barrier between the jacket and trousers, particularly when the zippers comprise preferred weatherproof zippers.

According to a third aspect of the present invention there is provided a garment set comprising:

a water resistant jacket including (i) a torso portion for covering a torso of a user in which the torso portion has a bottom edge and a closure mechanism operatively connected between two opposing front edges spanning a full height of the torso portion for movement between open and closed positions of the jacket, and (ii) a first upper zipper portion on an inner surface of the torso portion at a location spaced above the bottom edge and spanning in a circumferential direction about the torso portion between the opposing front edges;

water resistant trousers including (i) a main body for covering the legs of the user, and (ii) a waist opening in the main body receiving a waist of the user therethrough;

a barrier panel which is elongate in a longitudinal direction and which is adapted to be selectively coupled between the water resistant jacket and the water resistant trousers, the barrier panel including (i) a pair of opposing upper and lower edges extending in the longitudinal direction of the barrier panel between two end edges at longitudinally opposed ends of the barrier panel, the lower edge being joined to the trousers, (ii) a second upper zipper portion extending along the upper edge between the opposing end edges, the second upper zipper portion being adapted to be selectively joined with the first upper zipper portion along the length thereof, (iii) a pair of end zipper portions extending along the end edges respectively, the end zipper portions being adapted to selectively join with one another; and a cover panel joined externally to the trousers along an inner edge of the cover panel to define a pocket extending circumferentially about the waist opening in the trousers;

the lower edge of the barrier panel being joined externally on the trousers within the pocket defined by the cover panel such that the barrier panel can be concealed within the pocket defined by the cover panel.

The cover panel allows the barrier panel to be conveniently located on the exterior of the trousers in a manner which remains readily accessible for joining to the jacket when desired, but which also allows the barrier panel to be concealed when not in use.

Preferably the cover panel is joined to the trousers above a mounting location of the lower edge of the barrier panel on the trousers.

The trousers may further include a closure mechanism including a first closure portion mounted on the cover panel adjacent an outer edge of the cover panel which is opposite from the inner edge and a second closure portion mounted externally on the trousers, in which the first and second closure portions are adapted to be selectively joined to one another to retain the barrier panel within the pocket defined by the cover panel.

The barrier panel preferably has a width between the opposing upper and lower edges thereof which is greater than a width of the cover panel between the inner and outer edges thereof.

The upper edge of the barrier panel may be longer than the lower edge of the barrier panel.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
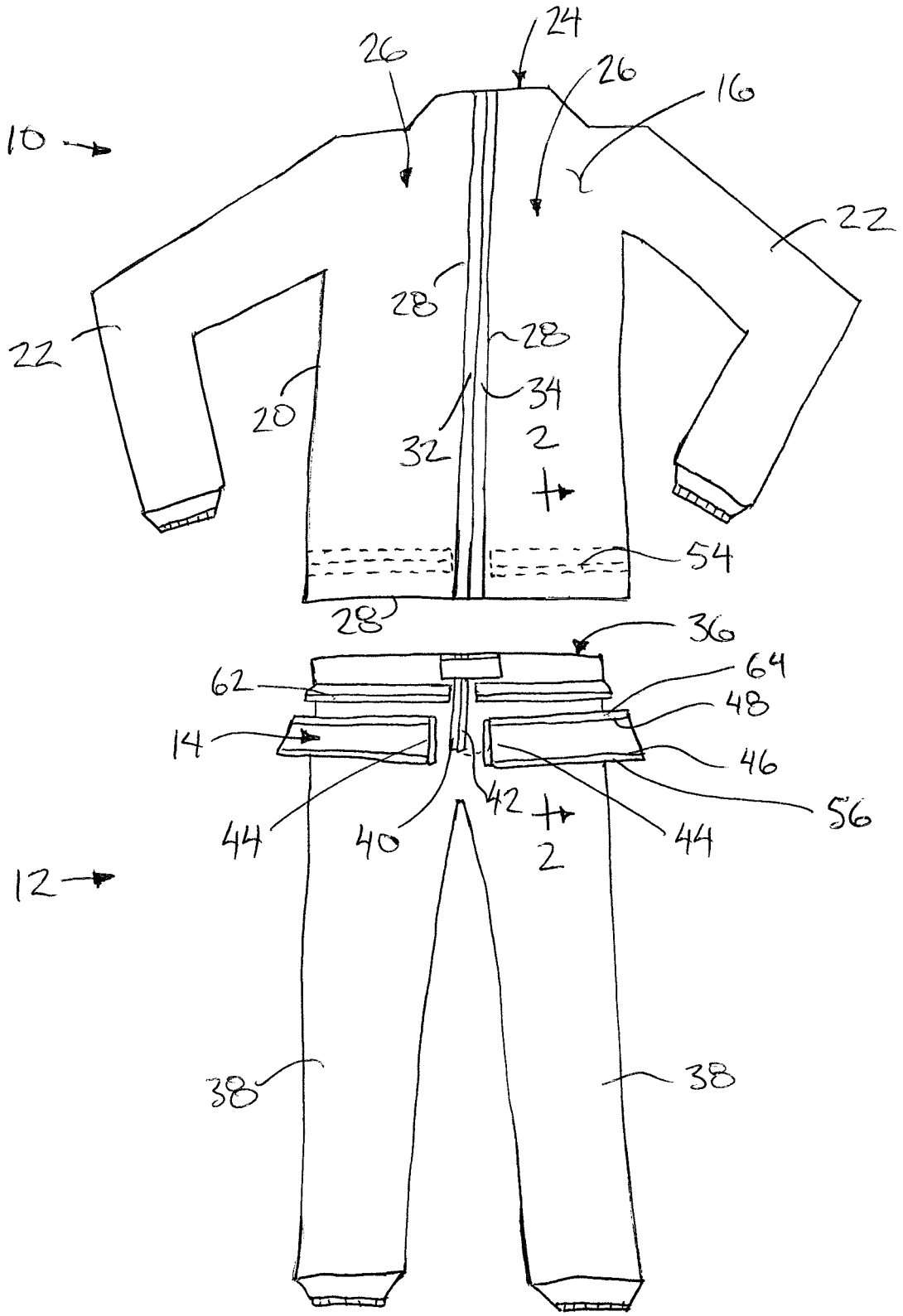
FIG. 1 is a schematic illustration of a first embodiment of the garment set including a jacket and trousers according to the present invention in which the barrier panel is positioned for ready attachment to the jacket and the trousers.
Figure 2:
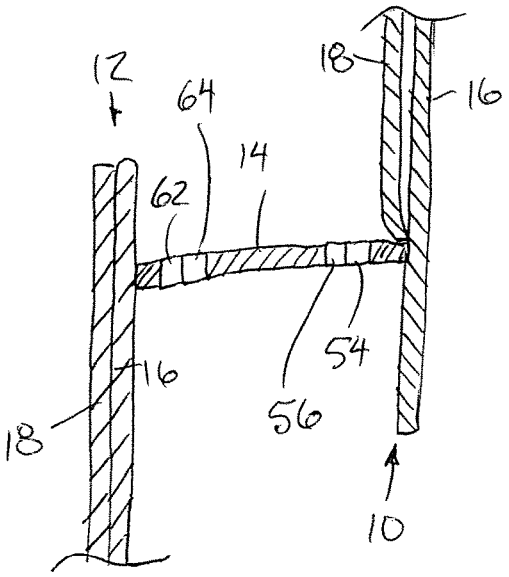
FIG. 2 is a sectional view generally along the line 2-2 in FIG. 1 in which the barrier panel is shown in a working position coupled between the jacket and the trousers.
Figure 3:
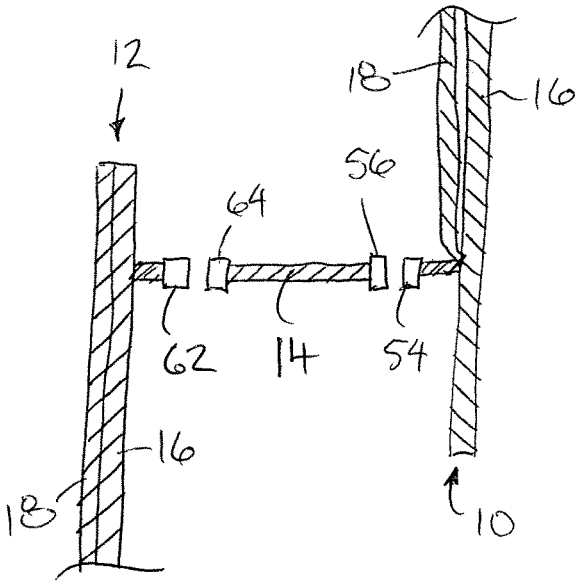
FIG. 3 is a sectional view generally along the line 2-2 in FIG. 1 in which the barrier panel is shown in a released position relative to the jacket and the trousers.
Figure 4:
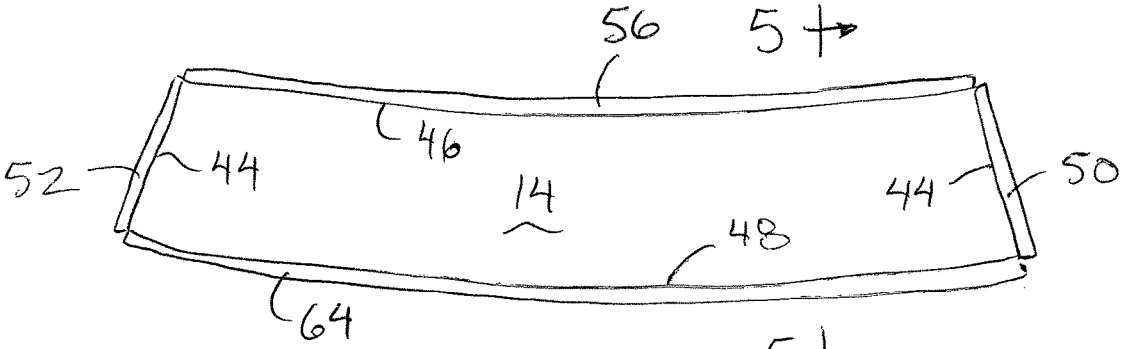
FIG. 4 is a plan view of the barrier panel shown separated from the garment set.

Referring to the accompanying Figures there is illustrated a garment set according to the present invention comprised of a jacket 10 and a pair of trousers 12 which can be selectively coupled to the jacket 10 using a barrier panel 14 which provides a barrier against cold air and moisture from entering into the garments at the junction therebetween. Each of the jacket 10 and the trousers 12 comprises an outer shell layer 16 and one or more heat insulating layers 18 lining the outer shell in the usual manner of a winter garment.

Although various embodiments are illustrated in the accompanying drawings, the features in common with the various embodiments will first be described.

The jacket 10 includes a torso portion 20 having a front side and a rear side which collectively span over the torso of a user. Two sleeves 22 are connected to the torso portion for covering arms of the user. An elasticized skirt may be integrated into the cuff to provide a barrier sealing the open ends of the sleeves about the rest of the user. A neck opening 24 is provided at the top end of the torso portion. The front side of the torso portion is formed as two separate panels 26 spanning forwardly from opposing edges of the rear side of the jacket towards respective front edges 28 which each extend vertically between the neck opening 24 at the top end of the jacket and a bottom edge 30 extending about the circumference of the torso portion at the bottom end thereof for extending about the waist of the user.

A front closure mechanism is coupled between the two front edges 28 to selectively join the front edges in a closed position of the jacket about the user. The front closure mechanism includes a first front zipper portion 32 and a second front zipper portion 34 mounted to fully span the two front edges 28 respectively. The front zipper portions can be selectively coupled or separated relative to one another in the form of a conventional zipper. When coupled, the first and second zipper portions join the front edges 28 in a waterproof manner.

The trousers 12 include a waist portion 36 having a top end which is annular about the top waist opening that receives the waist of the user therethrough. The waist portion 46 has front and rear sides joined to define a crotch area and a seat of the trousers. Two legs 38 of the trousers are joined to the waist portion to extend downwardly therefrom for receiving respective legs of the user therein. An elasticized skirt may be provided at the bottom cuff of each leg to provide a barrier between the bottom end of the leg 38 and the ankle of the user received therethrough.

The waist portion 36 of the trousers includes a front seam which can be opened and closed for ease of dressing and removal of the trousers relative to the user. A front closure mechanism is provided at the front seam in the form of a first front zipper portion 40 and a second front zipper portion 42 mounted along the corresponding front edges at opposing sides of the front seam which extend vertically between the crotch area and the top edge of the trousers that extends about the waist opening.

The barrier panel 14 is used for selectively joining the trousers to the jacket. In each instance, the barrier panel is generally elongate in a longitudinal direction between two opposing ends 44. At each end 44 an end edge is defined spanning the full lateral width between an upper edge 46 and a lower edge 48 of the barrier panel. The upper and lower edges span in the longitudinal direction along opposing upper and lower sides between the two opposing ends 44. In a coupled position of the barrier panel between the trousers and the jacket, the upper edge 46 is joined to the interior of the jacket substantially about the full circumference of the jacket about the torso of the user. More particularly the upper edge 46 extends between the two ends 44 when the two ends are located adjacent to one another at the two front edges at opposing sides of the front seam of the jacket respectively.

The lower edge 48 is joined to the exterior of the trousers to extend circumferentially about the waist opening so that the opposing ends 44 are located adjacent to respective ones of the two front edges of the front seam on the trousers. Typically, the upper edge is longer than the lower edge such that the barrier panel follows a slight radius of curvature along the longitudinal direction thereof when laid on a flat surface. In this manner, the length of the upper edge can correspond to the larger circumference of the jacket while the length of the lower edge corresponds to the smaller circumference of the trousers.

In the coupled position of the barrier panel between the jacket and the trousers, the opposing ends 44 are coupled to one another using an end closure mechanism which includes a first end zipper portion 50 along one end edge and a second end zipper portion 52 along the other end edge. Each of the first and second end zipper portions span laterally the full width between the opposing upper and lower edges of the barrier panel and are joined to one another for ready detachment in the usual manner of a zipper. When joined, the first and second end zipper portions form a waterproof seal between the end edges of the barrier panel, and the barrier panel forms a complete annulus between the jacket and the trousers.

An upper closing mechanism is provided for selectively joining the upper edge 46 of the barrier panel to the jacket. The upper closure mechanism includes a first upper zipper portion 54 which is fastened to the inner surface of the jacket at a location in proximity to but spaced slightly upward from the bottom edge of the torso portion. The first upper zipper portion extends about the full circumference of the torso portion between two opposing ends thereof located at the two front edges 28 respectively. A second upper zipper portion 56 of the upper closure mechanism spans the full length of the upper edge of the barrier panel between the opposing ends thereof. The first and second upper zipper portions can be selectively separated or joined relative to one another in the conventional manner of operating a zipper. When joined the upper zipper portions collectively form a waterproof junction between the barrier panel and the jacket.

The barrier panel itself comprises an elastic member 58 in the form of a flexible sheet spanning the full width in the lateral direction between the upper and lower edges thereof and spanning the full length in the longitudinal direction between the opposing ends thereof. The flexible sheet is formed of resilient, elastic material which is elastically deformable and stretchable in all directions including both directions along a lateral axis and both directions along a longitudinal axis, referred to as 4-way stretch. The barrier panel further includes a moisture resistant membrane 60 fully spanning one side of the elastic member 58 across the full width and full length thereof. The membrane comprises a flexible, elastic material which is applied as a coating to one side of the elastic member 58 such that the membrane resists moisture penetration therethrough. The moisture resistant membrane 60 is resilient and flexible together with stretching of the elastic member 58.

The lower edge 48 of the barrier panel is joined to the trousers by various means. In the embodiment of FIGS. 1 through 4, the barrier panel remains detachable from the trousers using a lower closure mechanism as described in further detail below, whereas in the second embodiment of FIGS. 5 through 7, the lower edge of the barrier panel is stitched so as to be non-removably attached to the trousers.

According to the first embodiment of FIGS. 1 through 4, the lower closure mechanism includes a first lower zipper portion 62 mounted on the exterior of the trousers so as to be in proximity to but spaced slightly below the top edge of the trousers which encircles the waist opening at the top end of the trousers. The first lower zipper portion is permanently attached by stitching to the exterior of the trousers. A second lower zipper portion 64 of the lower closure mechanism is stitched permanently along the lower edge of the barrier panel along the full length thereof between the opposing ends. The first and second lower zipper portions 62 and 64 can be operated relative to one another in the usual manner of a zipper for ready separation and for selective coupling to join the lower edge of the barrier panel to the trousers. When coupled together, the first and second lower zipper portions form a waterproof seam between the barrier panel and the trousers. In a fully coupled configuration of the barrier panel between the jacket and the trousers, the opposing ends 44 are joined together along the full lateral width thereof by the first and second end zipper portions 50 and 52 while the first and second upper zipper portions join the upper edge of the barrier panel to the trousers and the first and second lower zipper portions 62 and 64 join the lower edge to the trousers. The closure mechanisms about the full perimeter of the barrier panel provide for a complete barrier between the jacket and the trousers when coupled. By arranging the entirety of the barrier panel to be stretchable in all directions, a considerable freedom of movement is provided between the jacket and the trousers while in the coupled position that also provides a complete moisture barrier between the jacket and the trousers.

In the first embodiment, when it is desired for the jacket to be separated from the trousers, the barrier panel is fully detached from both the jacket and the trousers by separating the zipper portions of the upper and lower closure mechanisms respectively. The end zipper portions are also separated from one another. When it is subsequently desired to couple the jacket and the trousers, the first and second upper zipper portions are coupled to one another to join the upper edge of the barrier panel to the jacket, while the first and second lower zipper portions are selectively coupled to one another to join the lower edge of the barrier panel to the trousers. The end closure mechanism is also operated to join the first and second end zipper portions so that the barrier panel forms a complete annulus joined between the jacket and the trousers respectively.

Figure 5:
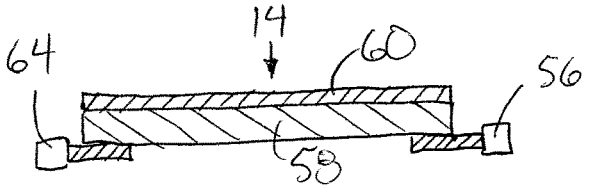
FIG. 5 is a sectional view along the line 5-5 in FIG. 4.
Figure 6:
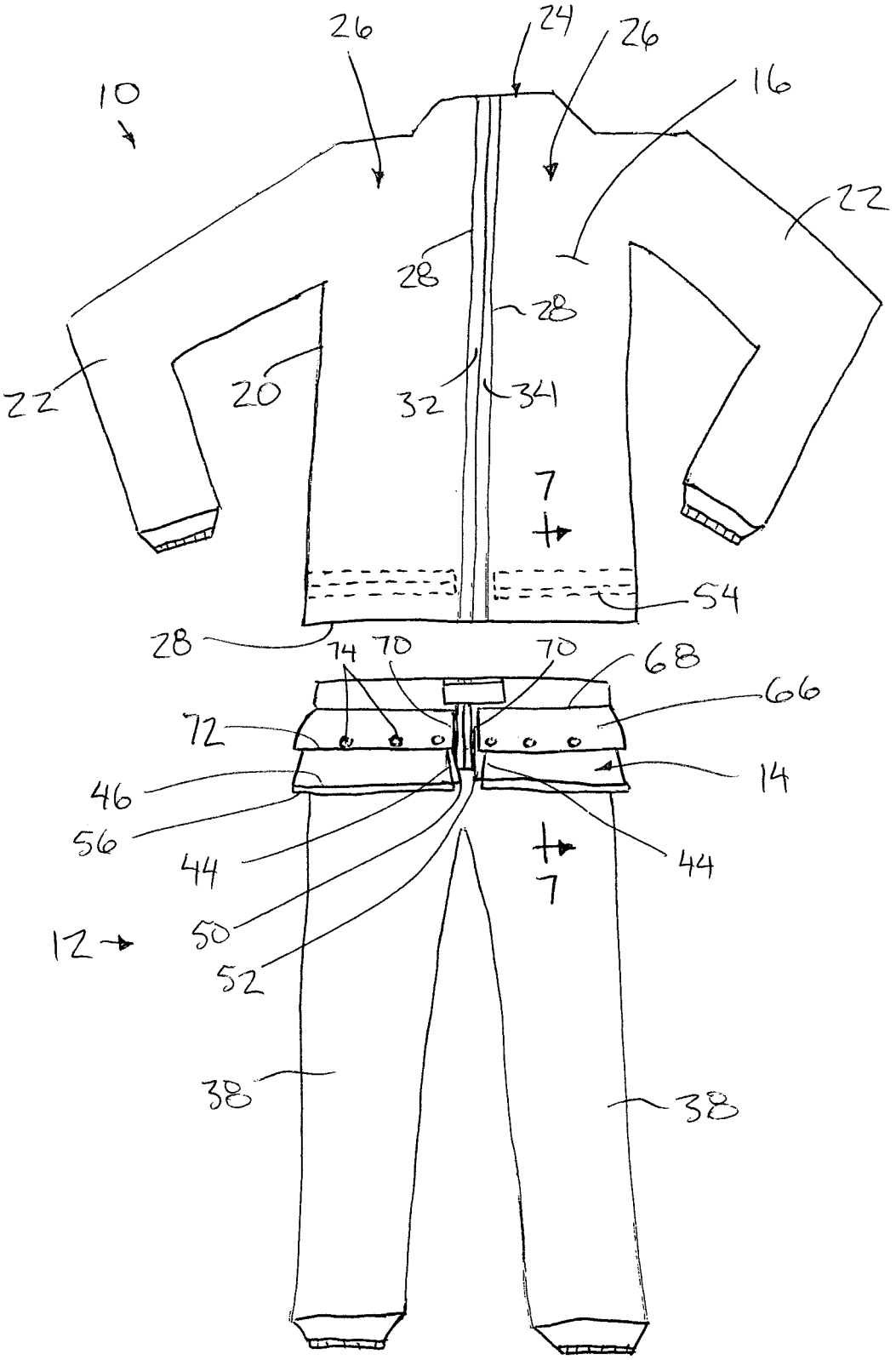
FIG. 6 is a schematic illustration of a second embodiment of the garment set according to the present invention in which the barrier panel is shown in a deployed position ready for attachment to the jacket.
Figure 7:
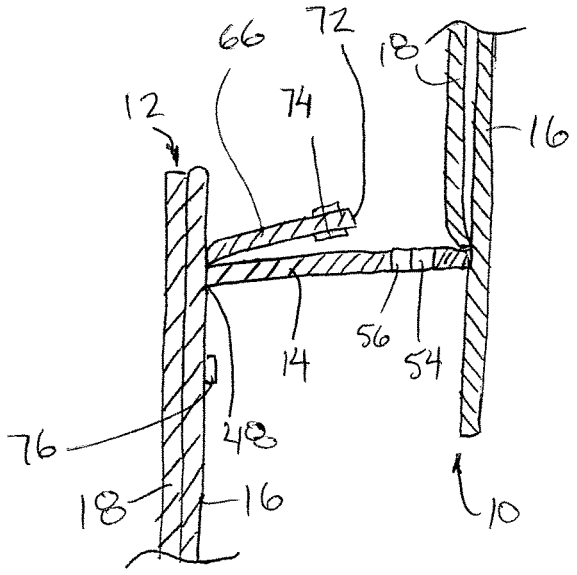
FIG. 7 is a sectional view generally along the line 7-7 in FIG. 6 in which the barrier panel is shown in a working position coupled between the jacket and the trousers.

Turning now to FIGS. 5 through 7, the lower edge in this instance is joined to the trousers by stitching at an external location on the trousers in proximity to but spaced slightly below the top end of the trousers to define a belt path encircling the top end of the trousers similarly to the first embodiment. The barrier panel is joined to the trousers such that the opposing end edges 44 are located directly adjacent the two front edges of the front closure mechanism of the trousers so that the barrier panel extends about the full circumference of the trousers.

The second embodiment further comprises a cover panel 66 also joined to the exterior of the trousers at a location spaced below the top end of the trousers so as to be located immediately above the barrier panel connection to the trousers. The cover panel includes an upper edge 68 which is received in a stitched seam together with the upper edge 48 of the barrier panel so that the cover panel also extends circumferentially about the entire circumference of the trousers between the two opposing front edges at the front seam in the trousers.

The cover panel 66 is similarly elongate between two opposing ends 70 which are located in close proximity to one another at the front seam in the trousers. A lower edge 72 of the cover panel which is parallel and opposite the upper edge stitched into the trousers remains a free edge that protrudes outwardly from the trousers when the barrier panel is arranged for ready connection to the jacket. The lateral width of the cover panel 66 between the upper and lower edges thereof is less than the lateral width of the barrier panel between the upper and lower edges thereof such that the barrier panel protrudes outwardly beyond the lower free edge 72 of the cover panel when in an unfolded position ready for attachment to the jacket.

The cover panel 66 is movable between a cover position concealing the barrier panel and a released position when the barrier panel protrudes outwardly from the cover panel for being connected to the jacket. In the cover position, the panel depends downwardly from the upper edge to the lower edge thereof to define a pocket between the cover panel and the exterior of the trousers from which the barrier panel protrudes for attachment to the jacket.

A cover closure mechanism is provided by a plurality of first fasteners 74 at spaced apart positions in the circumferential direction about the trousers and in the longitudinal direction of the cover panel adjacent to the lower edge of the cover panel for cooperation with second fasteners 76 mounted on the exterior of the trousers spaced below the connection of the upper edge of the cover panel to the trousers. Each second fastener 76 is arranged to be aligned with a corresponding first fasteners 74 when the cover extends downwardly along the exterior of the trousers in the cover position as shown in FIGS. 8 and 9.

In the illustrated embodiment, the first and second fasteners comprise male and female components of a set of snap fasteners, however any other configuration of fasteners may be used such as hook and loop fasteners, buttons, zippers and the like for selectively coupling the lower free edge of the cover panel to the exterior of the trousers in order to enable coupling of the cover panel to the trousers in the cover position. In the cover position of the cover panel, the barrier panel can be folded or rolled upwardly to be optionally fully received into the pocket defined between the cover panel and the exterior of the trousers corresponding to a storage position of the barrier panel.

Figure 8:
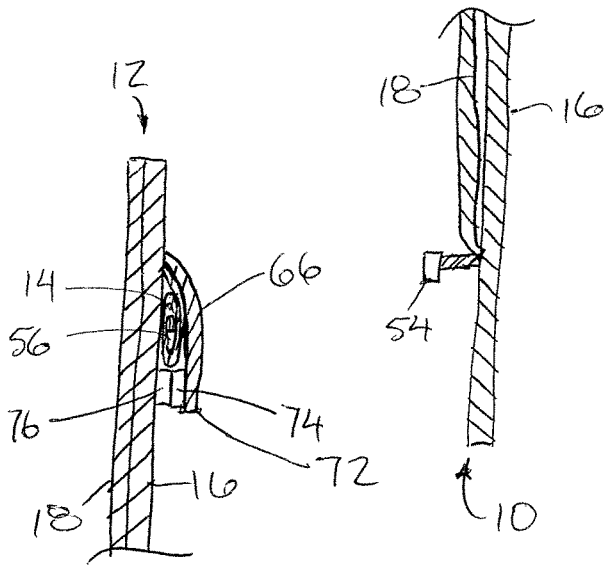
FIG. 8 is a sectional view along the line 7-7 in FIG. 6 in which the barrier panel is shown released from the jacket and folded into a stored position on the trousers.
Figure 9:
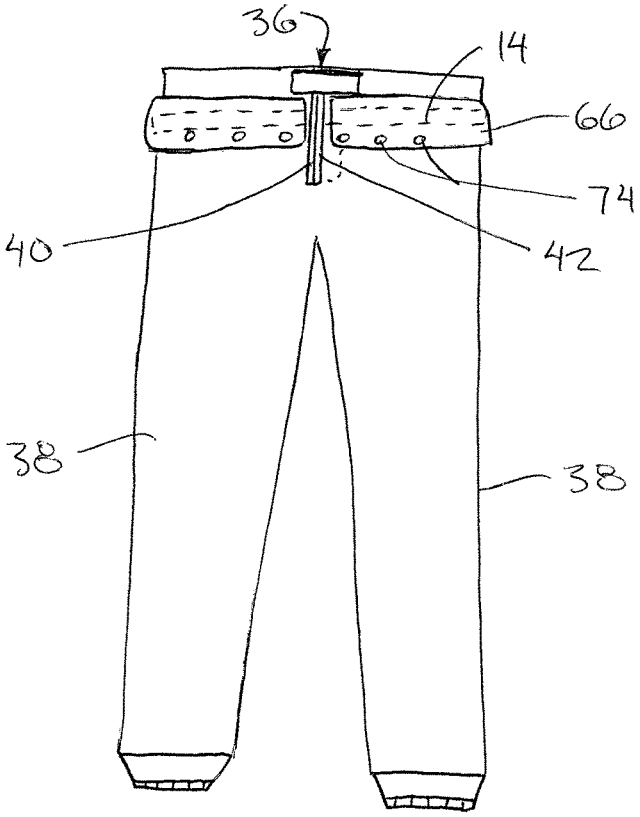
FIG. 9 is a schematic front elevational view of the trousers according to the second embodiment of FIG. 6 in which the barrier panel is shown folded into the stored position on the trousers.

In this instance, when it is desired to store the barrier panel, the barrier panel is folded or rolled up into the pocket defined by the cover panel according to FIGS. 8 and 9. When it is subsequently desired to couple the trousers to the jacket, the first and second fasteners are released from one another to open the pocket defined by the cover panel and allow the barrier panel to be extended outwardly from the pocket so that the upper edge 46 of the barrier panel protrudes outwardly from the pocket and is readily accessible for coupling to the jacket using the upper closure mechanism. The first and second upper zipper portions can then be selectively joined in the coupled position of FIG. 7. The end zipper portions are also joined together to join the ends 44 of the barrier panel to form a complete annulus in the circumferential direction about the user which is coupled between the jacket and the trousers.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A garment set comprising:

a water resistant jacket including (i) a torso portion for covering a torso of a user in which the torso portion has a bottom edge and a closure mechanism operatively connected between two opposing front edges spanning a full height of the torso portion for movement between open and closed positions of the jacket, and (ii) a first upper zipper portion on an inner surface of the torso portion at a location spaced above the bottom edge and spanning in a circumferential direction about the torso portion between the opposing front edges;

water resistant trousers including (i) a main body for covering the legs of the user, and (ii) a waist opening in the main body receiving a waist of the user therethrough; and a barrier panel which is elongate in a longitudinal direction and which is adapted to be selectively coupled between the water resistant jacket and the water resistant trousers, the barrier panel including (i) a pair of opposing upper and lower edges extending in the longitudinal direction of the barrier panel between two end edges at longitudinally opposed ends of the barrier panel, the lower edge being joined to the trousers, (ii) a second upper zipper portion extending along the upper edge between the opposing end edges, the second upper zipper portion being adapted to be selectively joined with the first upper zipper portion along the length thereof, (iii) a pair of end zipper portions extending along the end edges respectively, the end zipper portions being adapted to selectively join with one another;

the barrier panel comprising (i) an elastic member spanning in a lateral direction across a full width between the upper and lower edges of the barrier panel and spanning in the longitudinal direction across a full length between the opposing end edges of the barrier panel and (ii) a moisture resistant membrane spanning one side of the elastic member across the full width and across the full length of the barrier panel in which the moisture resistant membrane is resiliently deformable together with the elastic member;

whereby the barrier panel is fully resilient in both the lateral direction across the full width between the upper and lower edges and the longitudinal direction across the full length thereof between the opposing end edges.

2. The garment set according to claim 1 further comprising a cover panel joined externally to the trousers along one edge of the cover panel to define a pocket extending circumferentially about the waist opening in the trousers, the lower edge of the barrier panel being joined externally on the trousers within the pocket defined by the cover panel such that the barrier panel can be concealed within the pocket defined by the cover panel.

3. The garment set according to claim 1 wherein the upper edge of the barrier panel is longer than the lower edge of the barrier panel.

4. The garment set according to claim 1 further comprising a first lower zipper portion on the main body of the trousers to extend in a circumferential direction about the waist opening and a second lower zipper portion on the barrier panel extending along the lower edge between the opposing end edges, the second lower zipper portion being adapted to be selectively joined with the first lower zipper portion along the length thereof.

5. The garment set according to claim 1 further comprising a cover panel joined externally to the trousers along an inner edge of the cover panel to define a pocket extending circumferentially about the waist opening in the trousers, wherein the lower edge of the barrier panel is joined externally on the trousers within the pocket defined by the cover panel such that the barrier panel can be concealed within the pocket defined by the cover panel.

6. The garment set according to claim 5 wherein the cover panel is joined to the trousers above a mounting location of the lower edge of the barrier panel on the trousers.

7. The garment set according to claim 5 further comprising a closure mechanism including a first closure portion mounted on the cover panel adjacent an outer edge of the cover panel which is opposite from the inner edge and a second closure portion mounted externally on the trousers, the first and second closure portions being adapted to be selectively joined to one another to retain the barrier panel within the pocket defined by the cover panel.

8. The garment set according to claim 5 wherein the barrier panel has a width between the opposing upper and lower edges thereof which is greater than a width of the cover panel between the inner and outer edges thereof.

9. The garment set according to claim 5 wherein the upper edge of the barrier panel is longer than the lower edge of the barrier panel.

10. A garment set comprising:

a water resistant jacket including (i) a torso portion for covering a torso of a user in which the torso portion has a bottom edge and a closure mechanism operatively connected between two opposing front edges spanning a full height of the torso portion for movement between open and closed positions of the jacket, and (ii) a first upper zipper portion on an inner surface of the torso portion at a location spaced above the bottom edge and spanning in a circumferential direction about the torso portion between the opposing front edges;

water resistant trousers including (i) a main body for covering the legs of the user, (ii) a waist opening in the main body receiving a waist of the user therethrough, and (iii) a first lower zipper portion on the main body to extend in a circumferential direction about the waist opening; and a barrier panel which is elongate in a longitudinal direction and which is adapted to be selectively coupled between the water resistant jacket and the water resistant trousers, the barrier panel including (i) a pair of opposing upper and lower edges extending in the longitudinal direction of the barrier panel between two end edges at longitudinally opposed ends of the barrier panel, (ii) a second upper zipper portion extending along the upper edge across a full length of the barrier panel between the opposing end edges, the second upper zipper portion being adapted to be selectively joined with the first upper zipper portion along the length thereof, (iii) a second lower zipper portion extending along the lower edge across the full length of the barrier panel between the opposing end edges, the second lower zipper portion being adapted to be selectively joined with the first lower zipper portion along the length thereof, and (iv) a pair of end zipper portions extending along the end edges respectively across a full width of the barrier panel between the upper and lower edges, the end zipper portions being adapted to selectively join with one another;

whereby the second upper zipper portion along the upper edge of the barrier panel, the second lower zipper portion along the lower edge of the barrier panel, and the pair of end zipper portions along the end edges of the barrier panel collectively extend about a full perimeter of the barrier panel so as to be arranged to form a complete barrier between the jacket and the trousers.

11. The garment set according to claim 10 wherein the upper edge of the barrier panel is longer than the lower edge of the barrier panel.

12. A garment set comprising:

a water resistant jacket including (i) a torso portion for covering a torso of a user in which the torso portion has a bottom edge and a closure mechanism operatively connected between two opposing front edges spanning a full height of the torso portion for movement between open and closed positions of the jacket, and (ii) a first upper zipper portion on an inner surface of the torso portion at a location spaced above the bottom edge and spanning in a circumferential direction about the torso portion between the opposing front edges;

water resistant trousers including (i) a main body for covering the legs of the user, and (ii) a waist opening in the main body receiving a waist of the user therethrough;

a barrier panel which is elongate in a longitudinal direction and which is adapted to be selectively coupled between the water resistant jacket and the water resistant trousers, the barrier panel including (i) a pair of opposing upper and lower edges extending in the longitudinal direction of the barrier panel between two end edges at longitudinally opposed ends of the barrier panel, the lower edge being joined to the trousers, (ii) a second upper zipper portion extending along the upper edge between the opposing end edges, the second upper zipper portion being adapted to be selectively joined with the first upper zipper portion along the length thereof, (iii) a pair of end zipper portions extending along the end edges respectively, the end zipper portions being adapted to selectively join with one another; and a cover panel joined externally to the trousers along an inner edge of the cover panel to define a pocket extending circumferentially about the waist opening in the trousers;

the lower edge of the barrier panel being joined externally on the trousers within the pocket defined by the cover panel such that the barrier panel can be concealed within the pocket defined by the cover panel.

13. The garment set according to claim 12 wherein the cover panel is joined to the trousers above a mounting location of the lower edge of the barrier panel on the trousers.

14. The garment set according to claim 12 further comprising a closure mechanism including a first closure portion mounted on the cover panel adjacent an outer edge of the cover panel which is opposite from the inner edge and a second closure portion mounted externally on the trousers, the first and second closure portions being adapted to be selectively joined to one another to retain the barrier panel within the pocket defined by the cover panel.

15. The garment set according to claim 12 wherein the barrier panel has a width between the opposing upper and lower edges thereof which is greater than a width of the cover panel between the inner and outer edges thereof.

16. The garment set according to claim 12 wherein the upper edge of the barrier panel is longer than the lower edge of the barrier panel.

* * * * *